US005722378A

United States Patent [19]

Sawazaki et al.

[11] Patent Number: 5,722,378

[45] Date of Patent: Mar. 3, 1998

[54] IGNITION DETECTION CIRCUIT

[75] Inventors: Nobuyuki Sawazaki; Masaaki Taruya; Mitsuru Koiwa, all of Tokyo, Japan

[73] Assignee: Mitsubishi Denki Kabushiki Kaisha, Tokyo, Japan

[21] Appl. No.: 719,882

[22] Filed: Sep. 25, 1996

[51] Int. Cl.[6] ..... F02P 17/12

[52] U.S. Cl. ..... 123/644; 324/380; 324/388

[58] Field of Search ..... 123/644; 324/380, 324/388

[56] References Cited

U.S. PATENT DOCUMENTS

| | | | |
|---|---|---|---|
| 4,333,054 | 6/1982 | Walker | 324/380 |
| 5,146,907 | 9/1992 | Sawazaki et al. | 123/644 |
| 5,197,449 | 3/1993 | Okamoto et al. | 123/644 |
| 5,299,543 | 4/1994 | Taruya et al. | 123/479 |
| 5,373,826 | 12/1994 | Taruya et al. | 123/634 |

OTHER PUBLICATIONS

Patent Abstracts of Japan, for JP 7–259712, Sawazaki et al, Oct. 9, 1995.

*Primary Examiner*—Andrew M. Dolinar

*Attorney, Agent, or Firm*—Sughrue, Mion, Zinn, Macpeak & Seas, PLLC

[57] ABSTRACT

An ignition circuit IG converts a battery voltage into a high spark plug discharge voltage. A resistor R1 inserted into the power supply path L detects the current flowing through the ignition circuit by converting the current into a voltage, and a level shift circuit LS shifts the potential level at both terminals of the detection resistor. A level deviation detection circuit regulates the level of a deviation voltage developed across the detection resistor, which is caused when an electric current flows from the battery to the ignition circuit, and outputs the deviation voltage. A reference voltage generation portion sets a reference voltage to be compared with the deviation voltage by a comparator COM. A clamping circuit CL suppresses variations in the power supply voltage corresponding to the level deviation detection circuit and the comparator, and protects the level deviation detection circuit. Thus, the influence of a surge voltage exerted on the comparator embodied in a monolithic IC is greatly reduced. Moreover, the accuracy in detecting a load current at the time of engine ignition is enhanced.

4 Claims, 5 Drawing Sheets

IGNITION DETECTION CIRCUIT

BACKGROUND OF THE INVENTION

1. Field of the Invention

The present invention generally relates to an ignition device for an internal combustion engine, and more particularly to an ignition detection (or detector) device for detecting an operation of an ignition coil.

2. Description of the Related Art

FIG. 5 illustrates the configuration of a conventional ignition detection device disclosed in, for example, the Japanese Unexamined Patent Publication No. 4-334769 Official Gazette. This ignition detection device is disposed on a power supply path for supplying a power supply voltage to a single ignition circuit or to a plurality of ignition circuits. Further, this ignition detection device is operative to monitor a load current I flowing through the ignition circuit by way of a power supply path L from a battery and to thereby detect whether or not an abnormality or malfunction occurs in the ignition circuit. In this figure, reference character B designates a battery mounted on a vehicle. This battery B is operative to supply a power supply voltage to both of electric equipment provided in the vehicle and an ignition circuit (to be described later).

Reference character R1 denotes a detection resistor for detecting the load current I, which flows through the ignition circuit via the power supply path L from the battery B during an operation of the ignition circuit, from variation in a voltage level. Further, reference character $V_R$ represents a reference voltage generation portion for generating a reference voltage $V\epsilon$, which is to be compared with a voltage drop developed across the detection resistor R1, on the basis of a battery voltage $V_B$ supplied from the battery B. Moreover, reference character COM designates a comparator that uses the battery voltage $V_B$ as a power supply voltage. This comparator COM has a non-inverting input terminal, to which a positive voltage being somewhat lower than the positive electrode voltage of the battery B is inputted from the reference voltage generation portion $V_R$, and an inverting input terminal to which a decreased voltage detected from a terminal of the detection resistor R1 is inputted. Furthermore, reference character C denotes a smoothing capacitor for reducing a surge voltage superposed upon the positive electrode voltage of the battery B.

The reference voltage generation portion $V_R$ and the comparator COM are constructed as a monolithic integrated circuit (IC) 1. Further, an ignition detection device is composed of the detection resistor R1, the smoothing capacitor C and the monolithic IC 1.

Reference characters 3A and 3B represent ignition circuits. Each of these ignition circuits 3A and 3B has: Darlington-connected transistors Q1 and Q2; an ignition coil IG in which a terminal of a primary coil L1 is connected to the collectors of the transistors Q1 and Q2 and the other or opposite terminal of the primary coil L1 and the same side terminal of a secondary coil L2 are connected to the power supply path L and a high voltage is furnished from the opposite terminal of the secondary coil L2 to a spark plug (not shown) so as to cause an electric discharge therein; a current limiting resistor R connected to the emitter of the transistor Q2 and to the ground G; and a current limiting circuit CR for detecting a voltage developed across the current limiting resistor R and for limiting the signal level of an ignition signal to be applied to the base of the transistor Q1.

Next, an operation of the conventional ignition detection device of FIG. 5 will be described hereinbelow. The comparator COM constituted by the monolithic IC 1 is supplied with a power supply voltage from the battery B installed on the vehicle. Moreover, a voltage obtained by lowering the battery voltage $V_B$ by a reference voltage $V\epsilon$ is inputted to the non-inverting input terminal of the comparator COM from the reference voltage generation portion $V_R$.

If no ignition signal is inputted to the ignition circuits 3A and 3B under such conditions, each of the transistors Q1 and Q2 maintains an off-state thereof. Thus, the load current I by no means flows into the ignition circuits 3A and 3B from the battery B through the detection resistor R1 of the power supply path L. Therefore, there occurs no voltage drop owing to the detection resistor R1. Consequently, the positive electrode voltage $V_B$ of the battery, whose level is higher than the level of the voltage inputted to the non-inverting input terminal of the comparator 4 (COM), is inputted to the inverting input terminal thereof. Further, a signal, whose signal level is an L-level (namely, a 0-level), is outputted from the output terminal thereof to an ignition control circuit (not shown).

However, when an ignition signal, whose level is an H-level, is inputted to the ignition circuit 3A or 3B from the ignition control circuit (not shown) at ignition timing of an engine, the transistors Q1 and Q2 turn on. Then, the load current I flows from the battery 1 to the primary coil L1, which is connected to the collectors of these transistors, through the detection resistor R1. As a result, the voltage inputted to the inverting input terminal of the comparator COM is made to be lower than the non-inverting input voltage owing to the voltage drop developed across the detection resistor R1. Consequently, the signal, whose signal level is an H-level, is outputted from the output terminal of the comparator COM.

Moreover, if the load current I does not flow through the detection resistor R1 due to the turning-on failure of the transistors Q1 and Q2 of the ignition circuits 3A and 3B or due to the breakage or disconnection of the ignition coil IG though it is time to ignite or fire the engine, the voltage drop across the detection resistor R1 does not occur. Thus, a voltage, which is higher than the non-inverting input voltage, is still inputted to the inverting input terminal of the comparator COM, so that the signal, whose level is an L-level, is outputted from the output terminal thereof. Therefore, abnormalities or malfunctions of the ignition circuits A and 3B can be detected by monitoring variations in level of the output signal of the comparator COM by means of the ignition control circuit in synchronization with the ignition by the ignition circuits 3A and 3B.

As above described, in the case of the conventional ignition detection device, the positive electrode voltage (or potential) of the battery is inputted to the comparator COMP constituted by a monolithic IC. Further, a reference voltage is inputted thereto from the reference voltage generation portion which employs the positive electrode voltage as the reference voltage.

The vehicle is, however, equipped with various loads. Thus, a high surge voltage is often superposed on the positive electrode voltage (or potential) of the battery. Consequently, the conventional ignition detection device has encountered problems in that even if this surge voltage is reduced by the smoothing capacitor, sufficient effects are not obtained and that at the worst, the monolithic IC is destroyed by the surge voltage.

The present invention is accomplished to solve the aforementioned problems of the conventional ignition detection device.

SUMMARY OF THE INVENTION

It is, accordingly, an object of the present invention to provide an ignition detection device which can reduce the influence of a surge voltage exerted on a comparator as much as possible and can detect the load current with high accuracy.

To achieve the foregoing object, in accordance with an aspect of the present invention, there is provided an ignition detection circuit (hereunder sometimes referred to as a first ignition detection circuit of the present invention) that comprises: an ignition circuit for converting a voltage, which is applied thereto from a battery through a power supply path, into a high voltage and for supplying the high voltage to a spark plug so as to cause an electric discharge in the spark plug; a detection resistor, which is inserted into the power supply path, for detecting an electric current flowing through the ignition circuit by converting the current into a detection voltage; a reference voltage generation portion for generating a reference voltage to be compared with the detection voltage detected by this detection resistor; a level shift circuit for superposing a voltage having a predetermined level on the detection voltage and the reference voltage and for shifting the level of each of the detection voltage and the reference voltage by a predetermined voltage; a comparator for comparing the shifted detection voltage with the shifted reference voltage and for outputting a comparison signal; and a clamping circuit for suppressing variations in power supply voltage corresponding to the comparator and for protecting the comparator.

Thus, in the case of the first ignition detection circuit of the present invention, the influence of the high surge voltage, which is superposed on the power supply path, upon the comparator can be reduced considerably. Consequently, the reliability of the device can be largely increased without destroying the comparator. Moreover, the accuracy in detecting an ignition operation can be enhanced.

Further, in accordance with another aspect of the present invention, there is provided an ignition detection circuit (hereunder sometimes referred to as a second ignition detection circuit of the present invention) that comprises: an ignition circuit for converting a voltage, which is applied thereto from a battery through a power supply path, into a high voltage and for supplying the high voltage to the spark plug so as to cause an electric discharge in the spark plug; a detection resistor, which is inserted into the power supply path, for detecting an electric current flowing through the ignition circuit by converting the current into a detection voltage; a level shift circuit for shifting the level of each of potentials at both terminals of this detection resistor by the same level; a level deviation detection circuit for regulating a level of a deviation voltage developed across the detection resistor, which is caused when an electric current flows from the battery to the ignition circuit, and for outputting a deviation voltage; a reference voltage generation portion for setting a reference voltage to be compared with the deviation voltage; a comparator for comparing the deviation voltage, which is outputted from the level deviation detection circuit, with the reference voltage and for outputting a comparison signal; and a clamping circuit for suppressing variation in power supply voltage corresponding to the level deviation detection circuit and the comparator and for protecting an input to the level deviation detection circuit.

Thus, in the case of the second ignition detection circuit of the present invention, the level of the reference voltage can be freely set by regulating the level thereof in accordance with the level of the deviation voltage.

Moreover, in the case of the first or second ignition detection circuit of the present invention, the level shift circuit comprises a current mirror circuit that has: a first resistor having a terminal connected to a terminal of the detection resistor; a second resistor having a terminal connected to the other terminal of the detection resistor; a first constant current source connected between the other terminal of the first resistor and the ground; and a second constant current source connected between the other terminal of the second resistor and ground. Further, the same current is fed to the first and second resistors.

Thus, in the case of the first or second ignition detection circuit of the present invention, stable detection and reference voltages can be inputted to the comparator, regardless of variation in power supply voltage.

BRIEF DESCRIPTION OF THE DRAWINGS

Other features, objects and advantages of the present invention will become apparent from the following description of preferred embodiments with reference to the drawings in which like reference characters designate like or corresponding parts throughout several views, and in which.

DETAILED DESCRIPTION OF THE PREFERRED EMBODIMENTS

Hereinafter, the preferred embodiments of the present invention will be described in detail by referring to the accompanying drawings.

EMBODIMENT 1

Figure 1:
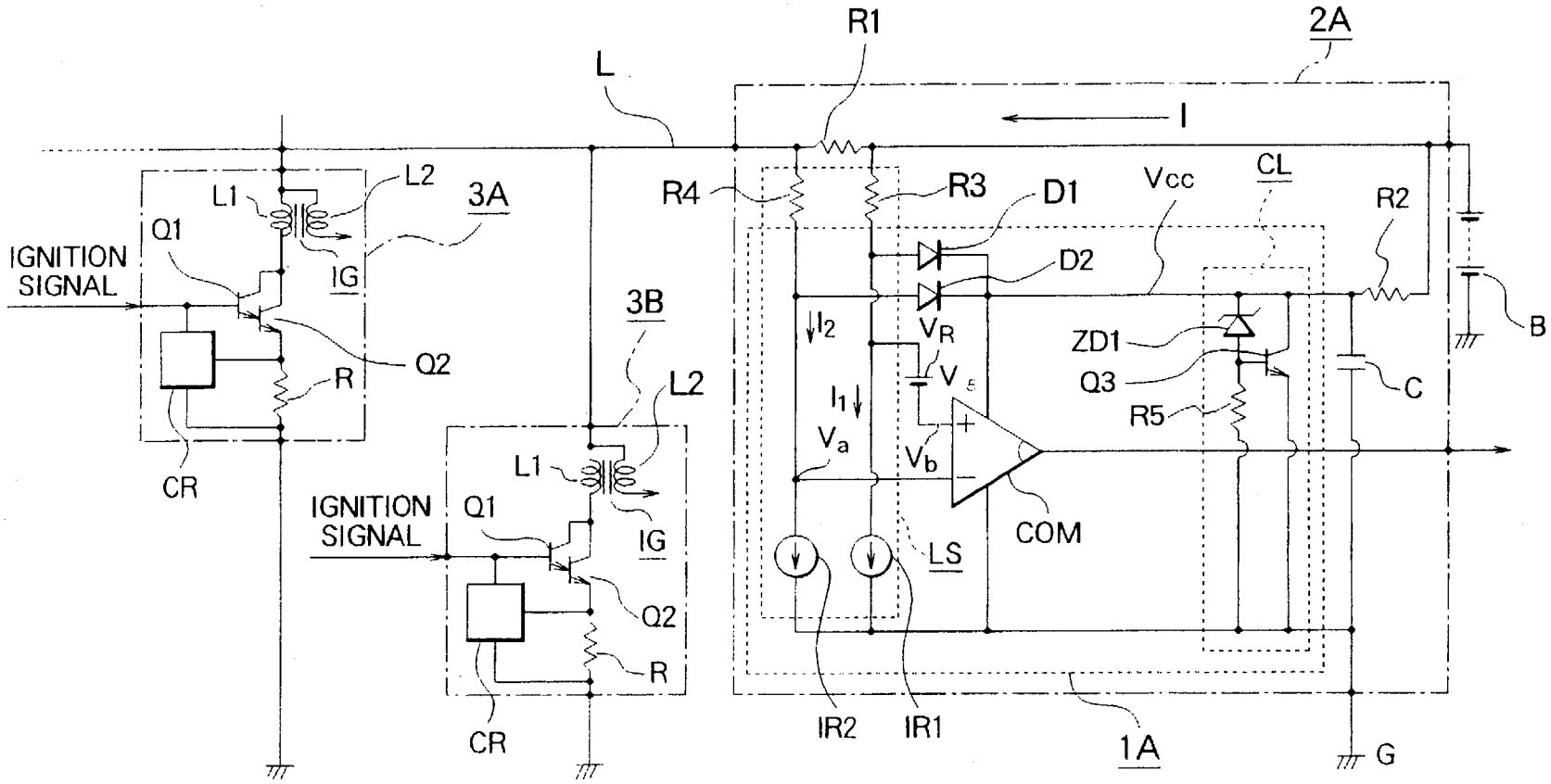
FIG. 1 is a diagram for illustrating the configuration of an ignition detection device embodying the present invention, namely, an embodiment of the present invention.
Figure 5:
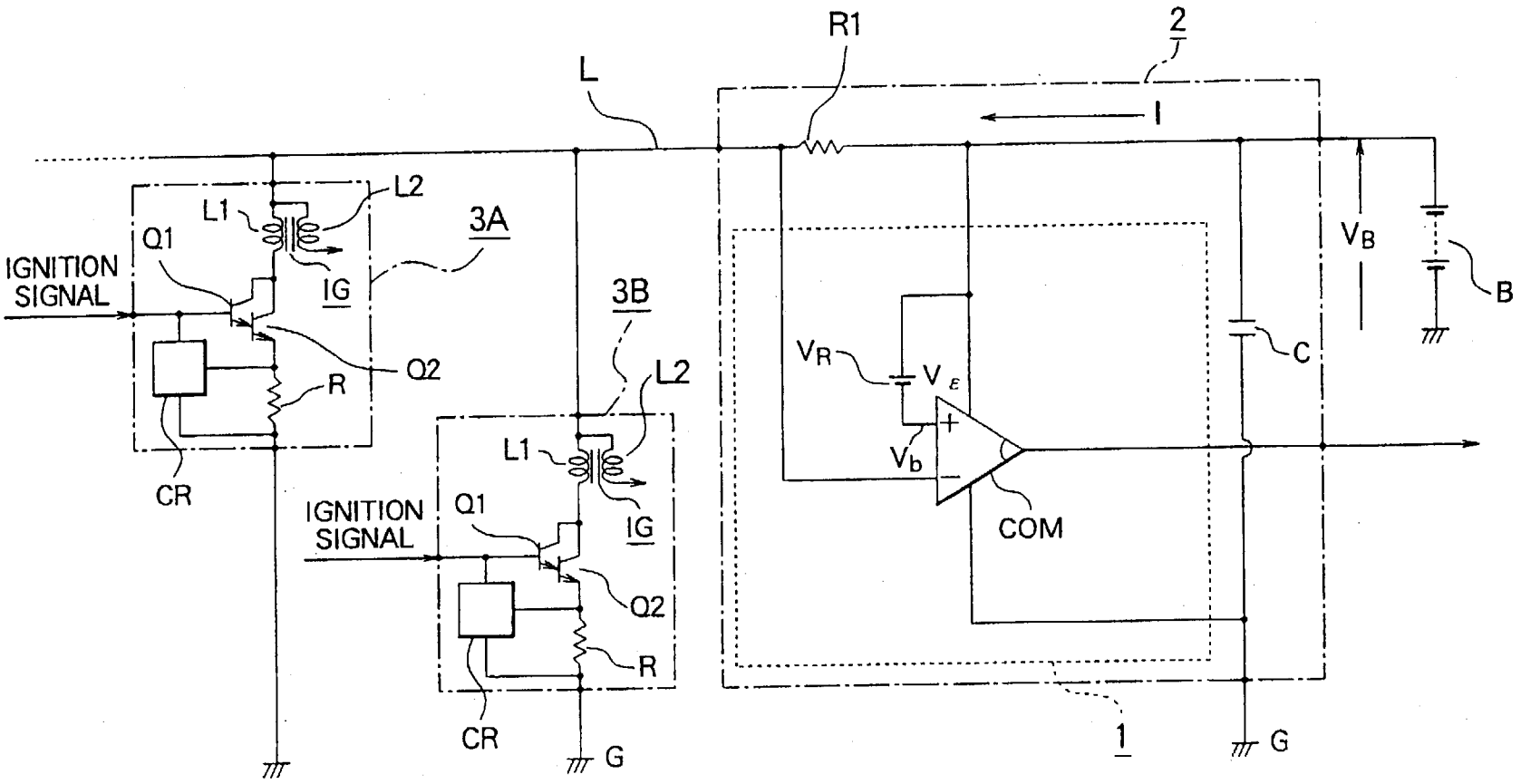
FIG. 5 PRIOR ART
FIG. 5 is a diagram for illustrating the configuration of the conventional ignition detection device.

A first embodiment, namely, "Embodiment 1" of the present invention will be described hereinbelow by referring to FIGS. 1 and 2. FIG. 1 illustrates the configuration of an ignition detection device according to this embodiment of the present invention. Incidentally, in these figures, like reference characters designate like or corresponding parts of FIG. 5. In FIG. 1, reference character 2A denotes the entire ignition detection device according to this embodiment of the present invention. The ignition detection device 2A comprises a monolithic IC 1A having a clamping circuit CL, which is operative to reduce the influence of a surge voltage superposed on the voltage or potential at the positive electrode of a battery B, and a level shift circuit LS, which is operative to shift the level of each of a reference voltage Ve and a detection (or detected) voltage to be inputted to a comparator COM, by the same level, as additional or new composing elements.

The monolithic IC 1A is connected with an input positive power supply line Vcc into which a power supply path L connected to the positive electrode of a battery B is branched by way of a resistor R2. Further, the level shift circuit LS comprises resistors R3 and R4, each of which has a terminal connected to a corresponding terminal of the detection resistor 2 (R1), and constant current sources IR1 and IR2, each of which is connected between the other terminal of the corresponding one of the resistors R3 and R4 and the ground G. Moreover, a voltage drop is developed across each of the resistors R3 and R4 owing to a corresponding constant current $I_1$ or $I_2$, which is fed from a corresponding one of the constant current sources IR1 and IR2. This voltage drop results in shift of signal levels at the input terminals of the comparator COM by the same amount or level.

Furthermore, the clamping circuit for protecting the input terminals of the comparator COM is composed of a diode D1, which has an anode connected to the connection or junction point between the resistor R3 and the constant current source IR1 and further has a cathode connected to the positive power supply terminal of the comparator COM, and a diode D2 which has an anode connected to the connection point between the resistor R4 and the constant current source IR2 and further has a cathode connected to the positive power supply terminal of the comparator COM.

Additionally, the clamping circuit CL for protecting the power supply for the comparator COM from a surge voltage is composed of a Zener diode ZD1, which has a cathode connected to the positive power supply line and further has an anode connected to the ground G through a resistor R5, and a transistor Q3 which has a base connected to the connection point between the Zener diode ZD1 and the resistor R5, a collector connected to the positive power supply line into which the power supply path L is branched, and an emitter connected to the ground G. When the Zener diode ZD1 is brought into conduction owing to the surge voltage and thus a predetermined voltage is developed across the resistor R5, the transistor Q3 turns on and absorbs the surge voltage.

Incidentally, the positive power supply line is led into the positive terminal of the comparator COM through the resistor R2 from the power supply path L. Therefore, the potential (or voltage) at the positive electrode of the monolithic IC 1A is by no means applied directly onto the monolithic IC 1A. Further, the level of the potential (or voltage) at the inverting input terminal of the comparator COM is shifted by a voltage (or potential) developed across the resistor R4. Moreover, the level of the potential (or voltage) at the non-inverting input terminal of the comparator COM is shifted by a voltage (or potential) developed across the resistor R3 in addition to the level of the reference voltage. At that time, the potential at each of the resistors R3 and R4 is set at a level which is lower than the level of the normal positive power supply voltage applied to the cathode of the corresponding one of the diodes D1 and D2. Further, the values of the constant currents I1 and I2 are set in such a manner that the diodes D1 and D2 are reverse-biased.

Next, an operation of this embodiment of the present invention will be described hereinbelow. When the ignition circuits 3A and 3B operate and the load current I flows through each of the ignition circuits 3A and 3B from the battery B through the detection resistor R1, a voltage drop is developed across the detection resistor R1 according to the value of the load current I. Thus, a voltage obtained by subtracting a voltage drop, which is developed across the detection resistor R1, and a voltage drop, which is developed across the resistor R4 owing to a constant current supplied from the constant current source IR2, from the battery voltage $V_B$ is applied to the inverting input terminal of the comparator COM.

Furthermore, a voltage obtained by subtracting a voltage drop, which is developed across the detection resistor R owing to a constant current flowing from the constant current source IR1, and a reference voltage Vϵ from the battery voltage $V_B$ is applied to the inverting input terminal of the comparator COM. At that time, the values of the constant currents $I_1$ and $I_2$, which are fed from the constant current sources IR1 and IR2, and the values of the resistors R3 and R4 are set in such a way that the voltage drop developed across the resistor R3 is equal to the voltage drop developed across the resistor R4. Therefore, the comparator COM simply compares the value of the voltage drop (namely, the detection (or detected) voltage), which is developed across the detection resistor R1, with a reference voltage Vϵ set by the reference voltage generation portion $V_R$. Thereby, the load current I is detected.

When the voltage applied to the inverting input terminal of the comparator COM becomes lower than the non-inverting input voltage, a comparison signal having an H-level is outputted from the comparator CM. Further, when no load current I flows owing to the failure of the ignition circuits 3A and 3B, a voltage, which is equal to the battery voltage $V_B$ having a level higher than that of the non-inverting input voltage, is applied to the inverting input terminal of the comparator COM, so that a comparison signal having an L-level is outputted from the output terminal thereof. Therefore, the load current I flowing through the ignition circuits 3A and 3B can be detected only by checking the logic level of the comparison signal.

The aforementioned relation among the load current, the potentials at the terminals of the comparator and so on is given by the following equations:

$$Vb=V_B-(R3\cdot I_1+V\epsilon) \quad (1)$$

$$Va=V_B-(R1\cdot I+R4\cdot I_2) \quad (2)$$

where Va is the potential at the non-inverting input terminal of the comparator; Vb the potential at the inverting input terminal of the comparator; I the load current flowing through the ignition circuit; $I_1$ the constant current flowing through the resistor R3; $I_2$ the constant current flowing through the resistor R4; and Vϵ the reference voltage.

Here, R3, $I_1$, R4 and $I_2$ are set in such a way that $R3\cdot I_1=R4\cdot I_2=\alpha$. As a result, Va and Vb are obtained by the following equations (3) and (4):

$$Va=V_B-R1\cdot I-\alpha \quad (3)$$

$$Vb=V_B-V\epsilon-\alpha \quad (4)$$

Moreover, in order to compare Va with Vb, $V_b$ is subtracted from Va. The result of this subtraction is given by the following equation (5):

$$Va-Vb=V\epsilon-R1\cdot I \quad (5)$$

Consequently, it is sufficient for detecting the load current I to simply compare the reference voltage Vϵ with the detection voltage developed across the detection resistor R1 due to the load current I. Next, an operation of a clamping circuit portion comprising the clamping circuit CL, the resistors R3 and R4 and the diodes D1 and D2 will be described hereunder. The function of the clamping circuit is to limit a voltage, which is supplied to the monolithic IC 1A, to a clamping voltage, and to thereby protect the monolithic IC 1A in the case that the surge voltage is superposed on a voltage fed to the ignition detection circuit 2A from the battery B through the power supply path L and thus the total voltage fed thereto is temporarily increased.

When the surge voltage is superposed on the battery voltage $V_B$ and the level of the voltage supplied to this circuit portion reaches the Zener voltage of the Zener diode ZD1, the Zener diode ZD1 causes a breakdown and is brought into conduction. Thus, a constant voltage is applied to the base of the transistor Q3 through the resistor R5.

As a consequence, the transistor Q3 turns on and thus bypasses a surge current fed from the battery B through the resistor R2 to the ground G. Thereby, the level of the voltage at the positive power supply line Vcc is clamped or fixed to a sum of the level of the base-emitter voltage of the transistor Q3 and the Zener voltage of the Zener diode ZD1 by "absorbing" the surge due to the voltage drop across the resistor R2. Consequently, the influence of the surge voltage against the power supply for the monolithic IC 1A can be prevented.

Meanwhile, the level of the input terminal voltage of the comparator COM is increased by superposing the surge voltage on the battery voltage $V_B$. Further, the diodes D1 and D2 are forward-biased against the positive power supply line Vcc which is then clamped by the clamping circuit CL. Thus, electric currents flow through the diodes D1 and D2 by way of the resistors R3 and R4, respectively. Moreover, voltage drops are developed across the resistors R3 and R4, respectively. Furthermore, a constant voltage ($V_F$) is developed between the anode and the cathode of each of the diodes D1 and D2. Hence, the surge voltage is consumed by the resistors R3 and R4 and the diodes D1 and D2. Consequently, the input terminals of the comparator COM are protected from the surge voltage.

Figure 2:
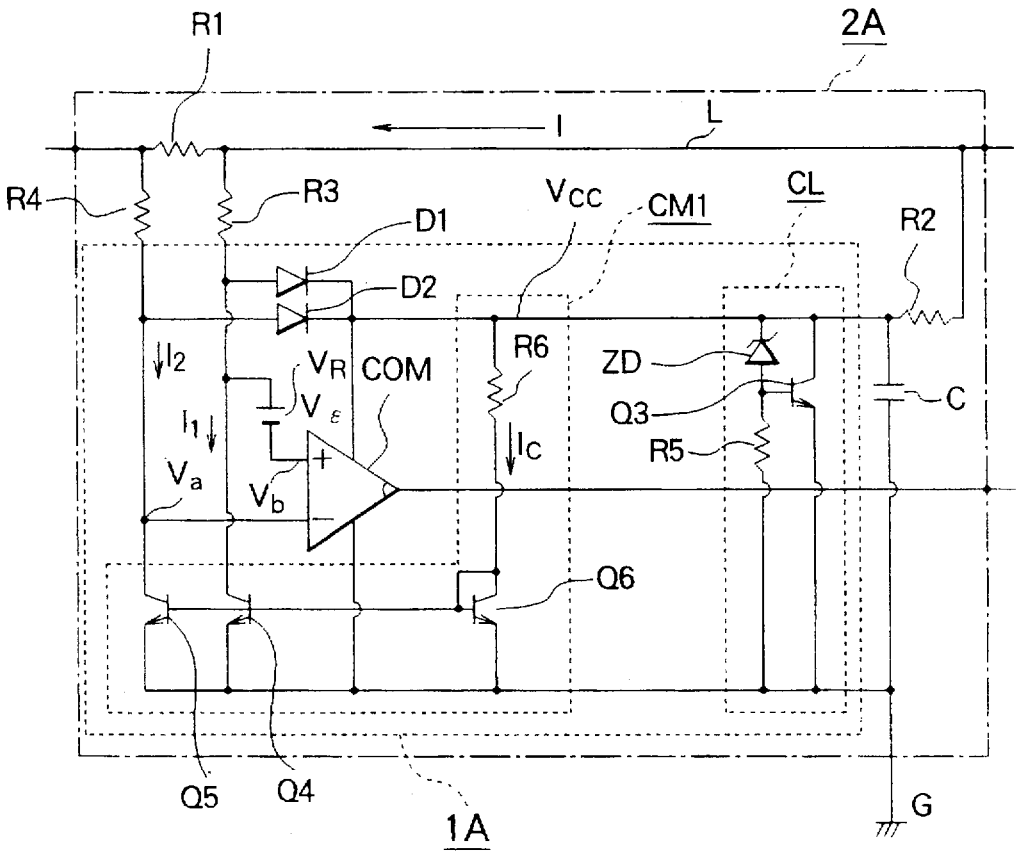
FIG. 2 is a diagram for illustrating the detailed configuration of a current mirror circuit constituting a level shift circuit of the embodiment of FIG. 1.

The constant current sources IR1 and IR2 of this embodiment of the present invention are constituted by a current mirror circuit CM1 comprising the transistors Q4 and Q5, which have the same characteristics (namely, collector-current ($I_c$) characteristics), and the transistor Q6, which is operative to feed common base currents to these transistors Q4 and Q5, and the resistor R6, which is operative to feed a collector current to the transistor Q6, as illustrated in FIG. 2.

These transistors Q4, Q5 and Q6 are connected in a common base configuration and further have emitters connected to the ground G. Moreover, the collector of the transistor Q4 is connected to the connection point between the resistor R3 and the anode of the diode D1. Furthermore, the collector of the transistor Q5 is connected to the connection point between the resistor R4 and the anode of the diode D2. Additionally, the collector of the transistor Q6 is connected to the base thereof (namely, a so called diode connection is established) and is further connected to the positive power supply line in the monolithic IC 1A.

The current mirror circuit CM1 performs the following operation. The transistor Q6, in which the diode connection is established, is supplied with a collector current Ic from the positive power supply line through the resistor R6. The collector current Ic at that time is given by the following equation (6).

$$Ic=(Vcc-V_{BE(Q6)})/R6 \quad (6)$$

where Vcc is a power supply voltage for the monolithic IC based on the battery voltage $V_B$; $V_{BE(Q6)}$ a base-emitter voltage (determined according to the collector current Ic).

Because the transistors Q4, Q5 and Q6 have a common base-emitter voltage, the same collector current Ic flows through these transistors Q4, Q5 and Q6, theoretically. Therefore, as is obvious from the equation (6), the collector current Ic of each of the transistors Q4, Q5 and Q6 changes according to variations in the voltage Vcc.

Based on the collector current Ic, the potential Va at the inverting input terminal of the comparator COM and the potential Vb at the non-inverting input terminal thereof are given by the following equations (7) and (8):

$$Va=V_B-R119\ I-R4\cdot(V_B-K-V_{BE(Q6)})/R6 \quad (7)$$

$$Vb=V_B-V\epsilon-R3\cdot(V_B-K-V_{BE(Q6)})/R6 \quad (8)$$

by setting $Vcc=V_B-K$.

From the aforesaid equations, the following equations (9) and (10) are obtained:

$$Va=V_B\cdot(1-(R4/R6))-R1\cdot I-(R4/R6)\cdot(V_{BE(Q6)}+K) \quad (9)$$

$$Vb=V_B\cdot(1-(R4/R6))-V\epsilon-(R4/R6)\cdot(V_{BE(Q6)}+K) \quad (10)$$

Here, note that Va and Vb can be maintained at constant values regardless of variations in the battery voltage $V_B$ by setting R4=R6 in such a way that in the aforementioned equations (9) and (10), the terms (1−(R4/R6))=0.

Next, the necessity of maintaining Va and Vb at constant values regardless of variations in the battery voltage $V_B$ will be described hereinbelow. The potentials Va and Vb are, in other words, the collector-emitter voltages of the transistors Q4 and Q5. Particularly, in the case of the current mirror circuit, it is required that the transistors Q4 and Q5 have the same characteristics.

It is, however, difficult to actually impart completely the same characteristics to the transistors. Especially, when the collector-emitter voltage becomes high, the difference in the characteristics results in an appreciably difference in collector current between the transistors. Consequently, the accuracy in detecting the current is enhanced by maintaining the potentials Va and Vb at constant values regardless of variations in the battery voltage $V_B$.

EMBODIMENT 2

The current mirror circuit of the aforementioned "Embodiment 1" of the present invention is constructed in such a manner that the collector-emitter voltage of each of the transistors Q4 and Q5 does not change according to variations in the battery voltage $V_B$. Thus, variations in collector current characteristics of each of the transistors Q4 and Q5 are absorbed.

However, there is another actual main factor of variations in collector current characteristics of the transistors, though this factor is not so significant as the influence of variance in the collector-emitter voltages thereof. Namely, this additional factor is the relation between the collector current and the base-emitter voltage of the transistor. Although there is no substantial difference between the collector currents respectively flowing through the transistors Q4 and Q5 in a region in which the collector current flowing through each of the transistors Q4 and Q5 is small, a noticeable difference therebetween is caused owing to the variation in the base-emitter voltage of the transistors when feeding a large collector current to each of the transistors.

The transistors Q4, Q5 and Q6 of the current mirror circuit CM1 have a common base-emitter voltage. Therefore, the collector current Ic of each of the transistors Q4 and Q5 is determined in such a way as to coincide with the base-emitter voltage developed by the collector current Ic flowing through the transistor Q6.

However, in a region in which the collector current Ic is large, a difference between the collector current characteristics of the transistors Q4 and Q5 is brought about.

Here, note that the value of a collector current $I_4$ flowing through the transistor Q6 depends on the battery $V_B$, as expressed in the following equation (11). Namely, as is obvious from the equation (11), the current $I_4$ flowing through the transistor Q6 slightly changes according to the battery voltage $V_B$.

$$I_4=(V_B-K-V_{BE(Q6)})/R6 \tag{11}$$

Figure 3:
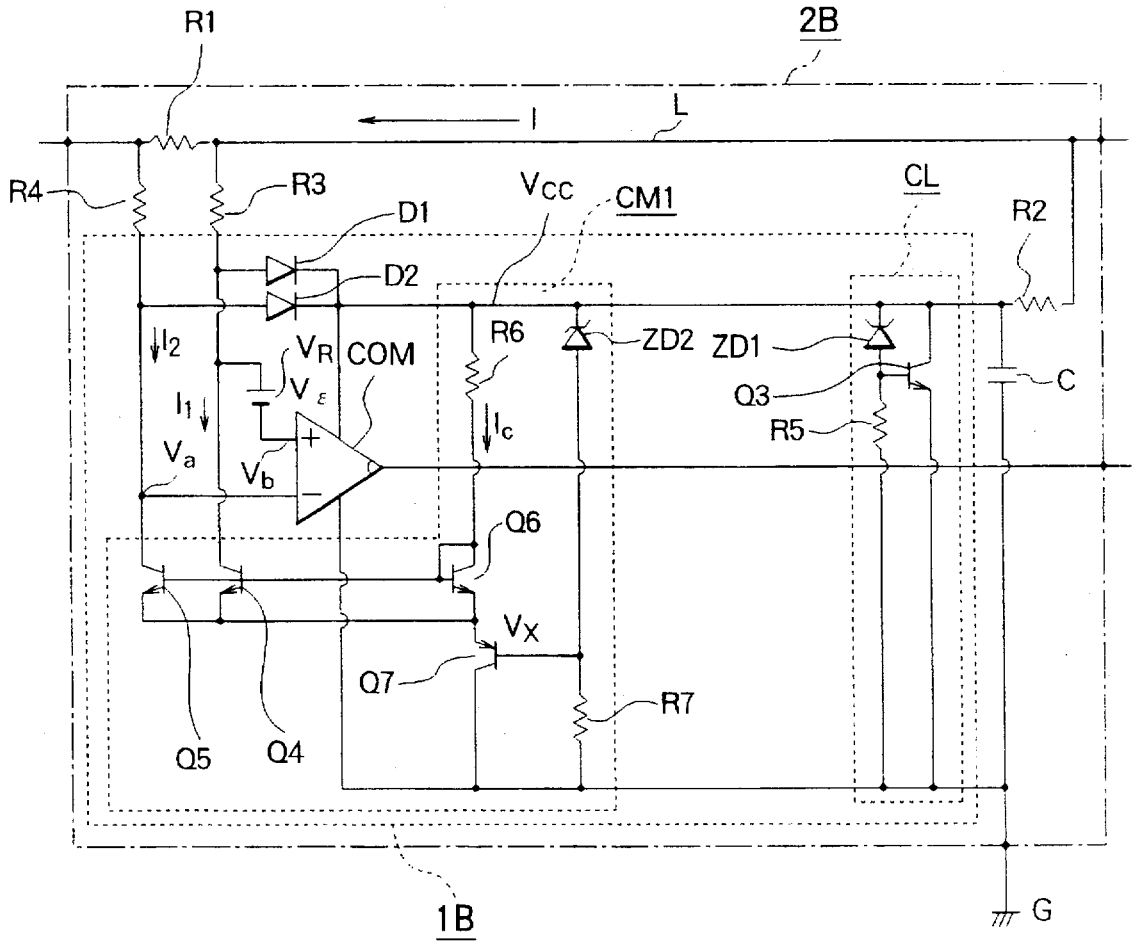
FIG. 3 is a diagram for illustrating the configuration of another ignition detection device embodying the present invention, namely, another embodiment of the present invention which employs a current mirror circuit whose configuration is different from that of the current mirror circuit of FIG. 2.

Thus, this "Embodiment 2" of the present invention provides an ignition detection device of the built-in monolithic IC type, which compensates for the aforementioned defect and contains a constant current source constituted by a current mirror circuit having higher accuracy in detecting a current. FIG. 3 is a diagram for illustrating the configuration of an ignition detection device 2B containing a monolithic IC 1B. Incidentally, in this figure, like reference characters designate like or corresponding parts of FIG. 2.

In FIG. 3, reference character ZD2 designates a Zener diode which has a cathode connected to a positive power supply line in the monolithic IC 1B and further has an anode connected to the ground through a resistor R7; and Q7 a transistor which is connected with the transistors Q4, Q5 and Q6 in a common emitter configuration, and further has a collector connected to the ground G and furthermore has a base connected to the connection point between the anode of the Zener diode ZD2 and the resistor R7.

The Zener diode ZD2 fixes the battery voltage Vcc led from the battery B through the resistor R2 and thus cancels out the influence of variations in the battery voltage $V_B$ for the current mirror circuit CM2. Further, the transistor Q7 turns on at a Zener voltage. Thereby, a constant voltage is developed between the base and the emitter thereof. Then, the emitter voltage $V_X$ of the transistor Q7 is set together with this base-emitter voltage $V_{BE}$, the Zener voltage $V_Z$ (corresponding to the Zener diode ZD2) and the battery voltage Vcc corresponding thereto.

Next, an operation of this "Embodiment 2" of the present invention will be described hereunder. The transistor Q6, in which the diode connection is established, is supplied with an electric current from the positive power supply line through the resistor R6. Further, let Ic denote the value of the electric current supplied at that time. The value Ic of the electric current is obtained by the following equation (12).

$$Ic=(V_{Z(ZD2)}-V_{BE(Q7)}-V_{BE(Q6)})/R6 \tag{12}$$

where $V_{Z(ZD2)}$ is the Zener voltage corresponding to the Zener diode ZD2.

The transistors Q4, Q5, Q6 have their bases and emitters connected in common with each other respectively. Theoretically, it follows that a collector current, which is the same as the collector current Ic of the transistor Q6, flows through the transistors Q4 and Q5. Thus, the voltage Va inputted to the inverting input terminal of the comparator COM and the voltage Vb inputted to the non-inverting input terminal thereof are given by the following equations (13) and (14).

$$Va=V_B-R1\cdot I-R4\cdot(V_{Z(ZD2)}-V_{BE(Q7)}-V_{BE(Q6)})/R6 \tag{13}$$

$$Vb=V_B-V\epsilon-R3\cdot(V_{Z(ZD2)}-V_{BE(Q7)}-V_{BE(Q6)})/R6 \tag{14}$$

Further, let $V_X$ denote the emitter voltage of each of the transistors Q4, Q5 and Q6. The emitter voltage $V_X$ is given by the following equation (15).

$$\begin{aligned} V_X &= Vcc-(V_{Z(ZD2)}-V_{BE(Q7)}) \\ &= (V_B-K)-(V_{Z(ZD2)}-V_{BE(Q7)}) \end{aligned} \tag{15}$$

Here, Vcc is expressed by using $V_B$. Further, it is assumed that $Vcc=V_B-K$.

The collector-emitter voltages of the transistors Q4 and Q5 are expressed by the following equations (16) and (17), respectively, which are obtained from the aforementioned equations (13), (14) and (15).

$$\begin{aligned} V_{CE(Q4)} &= Vb-V_X \\ &= (V_B-V\epsilon-R3\cdot(V_{Z(ZD2)}-V_{BE(Q7)}-V_{BE(Q6)})/R6)- \\ &\quad (V_B-K)+(V_{Z(ZD)}-V_{BE(Q7)}) \\ &= V_{Z(ZD2)}-V_{BE(Q7)}+K-V\epsilon-R3\cdot(V_{Z(ZD2)}-V_{BE(Q7)}- \\ &\quad V_{BE(Q6)})/R6 \end{aligned} \tag{16}$$

$$\begin{aligned} V_{CE(Q5)} &= Va-V_X \\ &= (V_B-R1\cdot I-R4\cdot(V_{Z(ZD2)}-V_{BE(Q7)}- \\ &\quad V_{BE(Q6)})/R6)-(V_B-K)+(V_{Z(ZD2)}-V_{BE(Q7)}) \\ &= V_{Z(ZD2)}-V_{BE(Q7)}+K-R1\cdot I-R4\cdot(V_{Z(ZD)}- \\ &\quad V_{BE(Q7)}-V_{BE(Q6)})/R6 \end{aligned} \tag{17}$$

Therefore, as is obvious from the aforementioned equations (16) and (17), the collector-emitter voltages of the transistors Q4 and Q5 do not depend upon the power supply (or battery) voltage $V_B$ and are constant or invariant.

EMBODIMENT 3

In the case of the aforementioned "Embodiment 1" and "Embodiment 2" of the present invention, a judgment concerning the detection of the load current I is made on the basis of a comparison between the voltage drop developed across the detection resistor R1 and the reference voltage Vϵ. It is, therefore, necessary to adjust the reference voltage Vϵ to the voltage drop developed across the resistor R1. In this case, in view of the influence of noise (namely, variations in voltage or current) superposed on the power supply path L, it is preferable that the reference voltage Vϵ be set at a voltage level which is sufficiently higher than the noise levels.

However, when obtaining a voltage drop, which is equal to the set voltage level, in normal times, an increase in the voltage drop due to the load current I should be caused by increasing the resistance of the resistor R1 to some extent. Nevertheless, the detection resistor R1 is inserted into the power supply path L. Thus, it is desirable that the constant should be extremely small in such a manner as to have no effect on the performance of each of the ignition circuits 3A and 3B.

Figure 4:
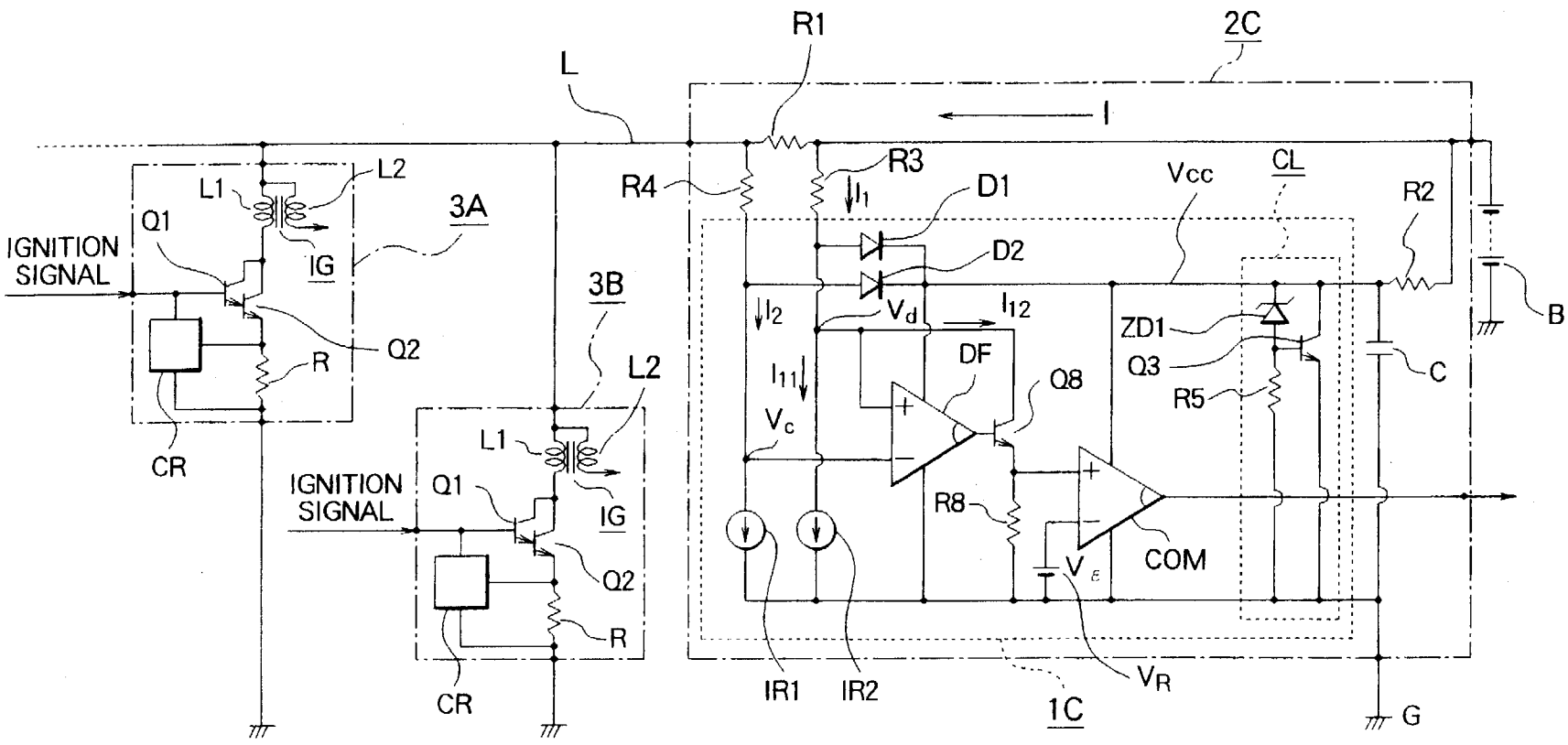
FIG. 4 is a diagram for illustrating the configuration of still another ignition detection device embodying the present invention, namely, still another embodiment of the present invention.

Thus, it is difficult to raise the level of the reference voltage Vϵ in the case of the circuit configuration of each of the aforementioned "Embodiment 1 " and "Embodiment 2" of the present invention, in which the level of the reference voltage Vϵ is limited by the detection resistor R1 and the load current I. This "Embodiment 3" is accomplished to resolve the aforementioned problem. FIG. 4 illustrates the configuration of an ignition detection device according to this embodiment. Incidentally, in this figure, like reference characters designate like or corresponding parts of FIG. 1. In FIG. 4, reference character 1C designates a monolithic IC of this embodiment. This monolithic IC 1C comprises: a differential amplifier DF, which has a non-inverting input terminal connected to the connection point between the resistor R3 and the constant current source IR1 and further has an inverting input terminal connected to the connection point between the resistor R4 and the constant current source IR2 and furthermore has an output terminal connected to the base of a transistor (to be described later) and acts as a level shift (or deviation) detection circuit for outputting difference voltages correspondingly to voltage drops developed across the resistor R3, the detection resistor R1 and the resistor R4, respectively; and a transistor Q8, which has a base connected to the output terminal of the differential amplifier DF, and further has a collector connected to the non-inverting input terminal of the differential amplifier DF, and furthermore has an emitter connected to the ground G through a resistor R8, in addition to the composing elements of the aforesaid "Embodiment 1".

The non-inverting input terminal of a comparator COM of this embodiment is connected to the connection point between the emitter of the transistor Q8 and the resistor R8. On the other hand, the inverting input terminal of the comparator COM thereof is connected to the output terminal of a reference voltage generation portion $V_R$. The level of the reference voltage Vϵ generated from the reference voltage generation portion $V_R$ is obtained by being raised from the ground level in a positive direction, namely, toward a positive level.

Next, an operation of this embodiment of the present invention will be described hereinbelow. When the ignition circuits 3A and 3B operate and the load current I is fed from the battery B to the power supply path L, a voltage drop is developed across the detection resistor R1 correspondingly to the load current I. As a result, a voltage, whose level is obtained by subtracting the voltage drop developed across the detection resistor R1 and the voltage drop developed across the resistor R4 from the battery voltage $V_B$, is applied to the inverting input terminal of the differential amplifier DF.

Further, a voltage, whose value or level is obtained by subtracting a voltage drop developed across the resistor R3 from the battery voltage $V_B$, is applied to the non-inverting input terminal of the differential amplifier DF. At that time, the level of the voltage applied to the non-inverting input terminal of the differential amplifier is higher than that of the voltage applied to the inverting input terminal thereof. Thus, the differential amplifier DF increases an electric current $I_1$. Consequently, the device of this embodiment operates in such a manner that Vc=Vd, namely, $I_1 \cdot R3 = R1 \cdot I + I_2 \cdot R4$.

Thus, the differential amplifier DF outputs a positive differential voltage to the base of the transistor Q8 to thereby turn on this transistor and feed an electric current (hereunder referred to as a pull-in current) from the emitter thereof to the resistor R8. Consequently, the current $I_1$ is increased from the constant current I, which is fed by the constant current source IR1, by an amount of the pull-in current $I_{12}$. Thus, the voltage drops respectively developed across the resistor R3, the detection resistor R1 and the resistor R4 are equalized.

When a voltage drop, which is higher than the reference voltage Vϵ, is developed across the resistor R8 owing to the pull-in current fed thereto at the time of equalizing the voltage drops, the comparator COM outputs a signal having an H-level and thus outputs a detection signal indicating that the load current I is detected.

The aforementioned operation of this embodiment will be described hereinbelow in detail.

First, when the load current I is fed, voltages indicated respectively by the following equations (18) and (19) are applied to the inverting input terminal and the non-inverting input terminal.

$$Vc = V_B - (R1 \cdot I + R4 \cdot I_2) \tag{18}$$

$$Vd = V_B - R3 \cdot I_1 \tag{19}$$

Here, the relation between the inverting input voltage Vc and the non-inverting input voltage Vd is expressed by the following equation (20) obtained from the equations (18) and (19).

$$Vc = Vd = R1 \cdot I + R4 \cdot I_2 = R3 \cdot I_1 \tag{20}$$

Moreover, the current $I_1$ flowing through the resistor R3 is given by the following equation (21) which is obtained by expanding the equation (20).

$$I_1 = (R1 \cdot I)/R3 + (R4 \cdot I_2)/R3 \tag{21}$$

Here, note that the voltage drop across the resistor R4 and the voltage drop across the resistor R3, which are caused by performing the initialization on the resistors R3 and R4 and the constant current values $I_{11}$ and $I_2$ meet the relation expressed by the following equation (22).

$$R4 \cdot I_2 = R3 \cdot I_{11} \tag{22}$$

The constant current $I_{11}$ flowing from the constant current source IR1 is given by the following equation (23) obtained by expanding the aforementioned equation (22).

$$I_{11} = (R4 \cdot I_2)/R3 \tag{23}$$

Accordingly, it is understood from the comparison made between the equations (21) and (23) that the current $I_1$ flowing through the resistor R3 is an added current composed of the constant current $I_{11}$ and the pull-in current $I_{12}$. Further, the pull-in current $I_{12}$ is given by the following equation (24).

$$I_1 = I_{11}(\text{corresponding to the constant current}) + I_{12}(\text{corresponding to the pull-in current}) \tag{24}$$

$$I_{12}\ (\text{corresponding to the pull-in current}) = I_1 - I_{11}(\text{corresponding to the constant current}) \tag{25}$$

Thus, $$\begin{aligned} I_{12}\ &(\text{corresponding to the pull-in current}) \\ &= (R1 \cdot I)/R3 + (R4 \cdot I_2)/R3 - (R4 \cdot I_2)/R3 \\ &= (R1 \cdot I)/R3 \end{aligned} \tag{26}$$

Assuming that a voltage to be applied to the non-inverting input terminal of the comparator COM is the voltage (namely, the non-inverting input terminal voltage) developed across the resistance R8, this voltage is given by the following equation (27).

$$I_{12} \cdot R8 = (R8/R3) \cdot R1 \cdot I \tag{27}$$

Thus, the comparator COM makes a comparison between the inverting input voltage (namely, the reference voltage Vϵ) and the non-inverting input voltage ($I_{12} \cdot R8$), as expressed by the following equation (28).

$$V\epsilon = (R8/R3) \cdot R1 \cdot I \tag{28}$$

As is obvious from the aforementioned equation (28), the detection voltage (namely, R1·I) developed across the detection resistor R1 can be amplified to a large value and inputted to the comparator COM as a non-inverting input voltage by setting the resistance of the resistor R8 at a value which is larger than the resistance of the resistor R3.

Consequently, the level or value of the reference voltage Vϵ can be set at a large value in such a manner as to adjust the reference voltage Vϵ to that of the non-inverting input voltage.

Although the preferred embodiments of the present invention have been described above, it should be understood that the present invention is not limited thereto and that other modifications will be apparent to those skilled in the art without departing from the spirit of the invention.

The scope of the present invention, therefore, should be determined solely by the appended claims.

What is claimed is:

1. An ignition detection circuit comprising:

an ignition circuit for converting a voltage, which is applied thereto from a battery through a power supply path, into a high voltage and for supplying the high voltage to the spark plug so as to cause an electric discharge in a spark plug;

a detection resistor, inserted into the power supply path, for detecting an electric current flowing through the ignition circuit by converting the current into a detection voltage;

a reference voltage generation portion for generating a reference voltage to be compared with the detection voltage detected by the detection resistor;

a level shift circuit for superposing a voltage having a predetermined level on the detection voltage and the reference voltage and for shifting the level of each of the detection voltage and the reference voltage by the predetermined voltage;

a comparator for comparing the shifted detection voltage with the shifted reference voltage and for outputting a comparison signal; and a clamping circuit for suppressing variations in power supply voltage corresponding to the comparator and for protecting the comparator.

2. An ignition detection circuit comprising:

an ignition circuit for converting a voltage, which is applied thereto from a battery through a power supply path, into a high voltage and for supplying the high voltage to a spark plug so as to cause an electric discharge in the spark plug;

a detection resistor, inserted into the power supply path, for detecting an electric current flowing through the ignition circuit by converting the current into a detection voltage;

a level shift circuit for shifting the level of each of potentials at both terminals of the detection resistor by the same level;

a level deviation detection circuit for regulating a level of a deviation voltage developed across the detection resistor, which is caused when an electric current flows from the battery to the ignition circuit, and for outputting the deviation voltage;

a reference voltage generation portion for setting a reference voltage to be compared with the deviation voltage;

a comparator for comparing the deviation voltage, which is outputted from the level deviation detection circuit, with the reference voltage and for outputting a comparison signal; and a clamping circuit for suppressing variations in power supply voltage corresponding to the level deviation detection circuit and the comparator and for protecting the level deviation detection circuit.

3. The ignition detection circuit according to claim 1, wherein the level shift circuit comprises a current mirror circuit that has:

a first resistor having a terminal connected to a terminal of the detection resistor;

a second resistor having a terminal connected to the other terminal of the detection resistor;

a first constant current source connected between the other terminal of the first resistor and ground; and a second constant current source connected between the other terminal of the second resistor and the ground, wherein the same current is fed to the first and second resistors.

4. The ignition detection circuit according to claim 2, wherein the level shift circuit comprises a current minor circuit that has:

a first resistor having a terminal connected to a terminal of the detection resistor;

a second resistor having a terminal connected to the other terminal of the detection resistor;

a first constant current source connected between the other terminal of the first resistor and ground; and a second constant current source connected between the other terminal of the second resistor and the ground, wherein the same current is fed to the first and second resistors.

* * * * *